US007266913B2

(12) United States Patent
Axt et al.

(10) Patent No.: US 7,266,913 B2
(45) Date of Patent: Sep. 11, 2007

(54) INSOLE

(75) Inventors: Matthias Axt, Armidale (AU); Leonhard Doderlein, Schriesheim (DE); Josef Jacobs, Bedburg-Hau (DE); Peter Lauer, Kleve (DE)

(73) Assignee: Dosenbach-Ochsner AG Schuhe und Sport, Dietikon (CH)

( * ) Notice: Subject to any disclaimer, the term of this patent is extended or adjusted under 35 U.S.C. 154(b) by 305 days.

(21) Appl. No.: 10/430,673

(22) Filed: May 5, 2003

(65) Prior Publication Data

US 2005/0257401 A1 Nov. 24, 2005

(30) Foreign Application Priority Data

May 3, 2002 (DE) ..... 102 20 004

(51) Int. Cl.
*A43B 13/38* (2006.01)

(52) U.S. Cl. ..... 36/174; 36/43; 36/180

(58) Field of Classification Search ..... 36/43, 36/44, 92, 142, 143, 144, 166, 173, 174, 36/180, 181
See application file for complete search history.

(56) References Cited

U.S. PATENT DOCUMENTS

| | | | | |
|---|---|---|---|---|
| 2,081,474 A | | 5/1937 | Burns | |
| 2,599,317 A | * | 6/1952 | Brady | 36/44 |
| 2,790,254 A | | 4/1957 | Burns | |
| 3,825,017 A | * | 7/1974 | Scrima | 36/181 |
| 4,510,700 A | * | 4/1985 | Brown | 36/44 |
| 4,580,356 A | * | 4/1986 | David | 36/43 |
| 4,928,404 A | * | 5/1990 | Scheuermann | 36/92 |
| 5,063,692 A | * | 11/1991 | Suginaka | 36/43 |
| 6,286,232 B1 | * | 9/2001 | Snyder et al. | 36/43 |
| 6,408,543 B1 | * | 6/2002 | Erickson et al. | 36/44 |
| 6,604,301 B1 | * | 8/2003 | Manoli et al. | 36/43 |
| 6,931,763 B2 | * | 8/2005 | Bray et al. | 36/44 |
| 2002/0083618 A1 | * | 7/2002 | Erickson et al. | 36/44 |
| 2004/0020078 A1 | * | 2/2004 | Bray et al. | 36/44 |

FOREIGN PATENT DOCUMENTS

| | | |
|---|---|---|
| DE | 912546 | 5/1954 |
| DE | 1763771 | 3/1958 |
| DE | 22149 | 1/1959 |
| DE | 1887405 | 2/1964 |
| DE | 8214895.3 | 10/1982 |
| DE | 9002962.3 | 6/1990 |

* cited by examiner

*Primary Examiner*—Ted Kavanaugh
(74) *Attorney, Agent, or Firm*—Patterson, Thuente, Skaar & Christense, P.A.

(57) ABSTRACT

The invention relates to a insole for footwear in the form of a sole insert with at least one hindfoot part and a midfoot part and with a support for the medial longitudinal arch, wherein a first rise is provided in the region of an insert outer border of the hindfoot part and a second rise is provided in the region of the insert outer border of a midfoot part, and the first rise is formed higher than the second rise.

17 Claims, 1 Drawing Sheet

INSOLE

BACKGROUND OF THE INVENTION

The invention relates to an insole for footwear.

The statics and dynamics of the foot are influenced by footwear. The selection of material and geometrical design of the sole of a shoe are of particular significance for the sequences of movements during walking. A deliberate manipulation of the walking action and the pressure distribution under the foot is possible to a certain extent by means of a insoleding. In particular at the growing stage, that is in the case of children and young adults, poor static positions of the foot influenced unfavourably by footwear can lead to permanent foot injuries. With a specific foot bedding the intention is to reduce deforming forces acting on the foot, as may be represented by shoes and hard surfaces (the road), and to encourage the natural development of the foot.

Known for example is a plastic foot bedding with a medial border elevation for medial support in the region of the hind part of the foot. Relief in this case relates essentially to the standing position. Since such a foot bedding is used in a mass-produced shoe and does not require orthopaedic custom fabrication, it is at least possible for it to be used in any shoe. However, the biomechanics of the foot during walking, running or jumping are not provided with any support by such a foot bedding.

It is therefore an object of the invention to provide an insole which complies the function of the normal foot during walking.

SUMMARY OF THE INVENTION

According to the invention, this object is achieved by means of the features of claim 1.

Provided as a result is an insole which encourages the natural motion of the foot during walking, in that it guides the foot into the path of movement of a healthy foot by means of natural stimulation from the sole.

For this purpose, a surface profile of the insole which effects an outward turning, i.e. pronation, of the forefoot during the walking phase is provided. The pronation of the forefoot is in this case combined with an inward turning, i.e. a supination, of the hindfoot by raising of the heel region inwards to achieve an elevation of the longitudinal arch of the foot. Altogether, the foot is given the (naturally existing) possibility of locking during the walking action to form a rigid forefoot lever and thus transferring (passing on) the forces of the hindfoot to the forefoot. The topography of the insert consequently contributes to the stabilization of the foot and counteracts the development of talipes valgus/planus.

Apart from the mechanical function, the surface profile of the insert additionally has a stimulating function over the sole of the foot. The insole improves the natural play of the muscles, which is generally impaired when wearing a shoe by contrast with walking barefoot.

The insole consequently serves for preventing acquired foot deformities caused by a reduction in the play of the muscles in a purchased shoe.

A first rise at the lateral region of the hindfoot preferably stimulates the twisting of the forefoot by means of activating the long fibular muscle. Its tendon enters the sole of the foot via a cleft on the outer side of the Os cuboideum and anchors itself on the base of the metatarsal I and on the Os cuneiforme mediale. A rise preferably level with this cleft stimulates the tendon by means of stretching and thereby induces the large fibular muscle to contract more intensely. As a typical stance phase muscle, the large fibular muscle lowers the first metatarsal ray (big toe) when the foot is subjected to loading, and consequently supports the formation of the longitudinal arch at the growing age. The stimulation of the region by raising can be referred to as proprioreceptive action. Proprioreception refers to the sensory reception of stimuli, the encoding of them into neurological signals and the passing on of these signals to the central nervous system.

In comparison with the first rise, which is intended to impart proprioceptive stimuli, the second rise is preferably of a much flatter form, to support the natural twisting of the forefoot in comparison with the hindfoot. In the middle of the stance phase, the foot carries out an eversion about the lower ankle joint axis, whereby the foot is dorsally extended, abducted and pronated. This eversion is restricted by medially situated components of the Ligamentum interosseum, the Ligamentum canalis. Apart from the rotation of the talus about the Calcaneus during the eversion, the talus is also displaced forwards from the eversion position, so that it is pressed into the talo-navicular joint, whereby this joint is locked. At the same time, the movement in the Calcaneo cuboid joint during the eversion is restricted by taut closure of the joint surfaces and tightening of the ligaments.

The twisting of the forefoot during walking caused by the second rise is preferably intensified by a slight depression of the first metatarsal ray, whereby the raising of the forefoot outer border is supported, to improve the introduction of force between the hindfoot and midfoot and the stability in the pushing-off phase.

Furthermore, the hindfoot part preferably has a central rise, which together with a small rise at the border provides a natural distribution of the heel pad. The heel is consequently fixed in the centre and the impact is displaced slightly forwards.

The insole may in this case be exchangeably positionable in footwear or incorporated directly in the lasting bottom of a shoe.

Further refinements of the invention can be taken from the following description and the subclaims.

DESCRIPTION OF THE FIGURES

The invention is explained in more detail below on the basis of the exemplary embodiment represented in the accompanying drawing.

DESCRIPTION OF PREFERRED EMBODIMENTS

The invention relates to a insole for footwear in the form of a sole insert with at least one hindfoot part 1 and a midfoot part 2. The hindfoot part 1 and the midfoot part 2 are formed on a basic insert made of a compressively elastic material, the material selection being governed by the target group of children or adults. The insole is intended in particular for children, but may also be used for adults. The basic insert provides a certain damping, which is favourable because of predominant walking on asphalt. Preferably arranged on the basic insert is a cover layer, for example made of leather, with which the climatic conditions in the shoe can also be improved.

Of special significance for the sequences of movements during walking is not only the material selection for the insert but also the geometrical design of the insert. Geometrical design is understood here as meaning the topography of the insert with respect to the foot, to be precise independently of the shoe size. The insole can be produced in sizes from 27 up to outsizes.

Figure 3:
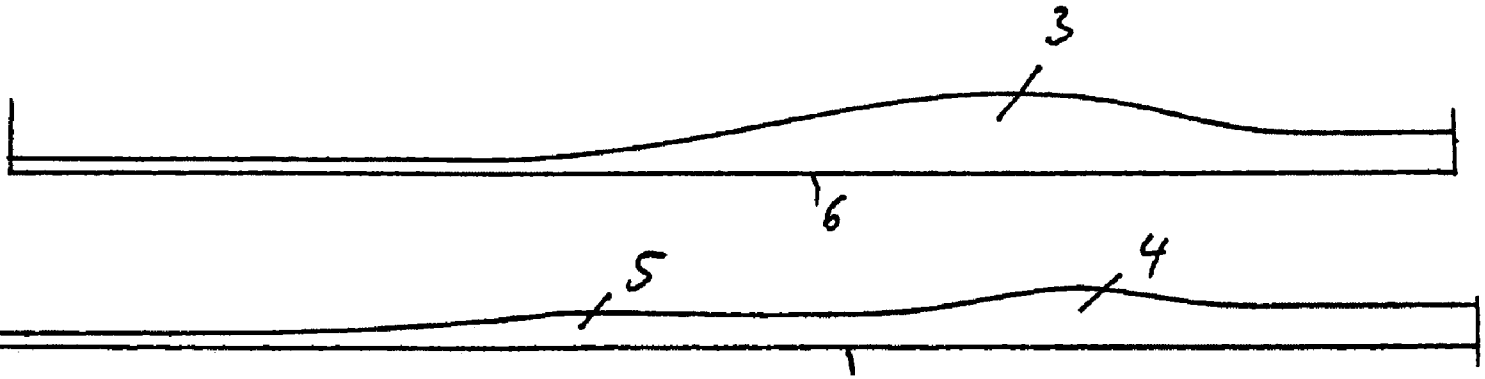
Figure 2:
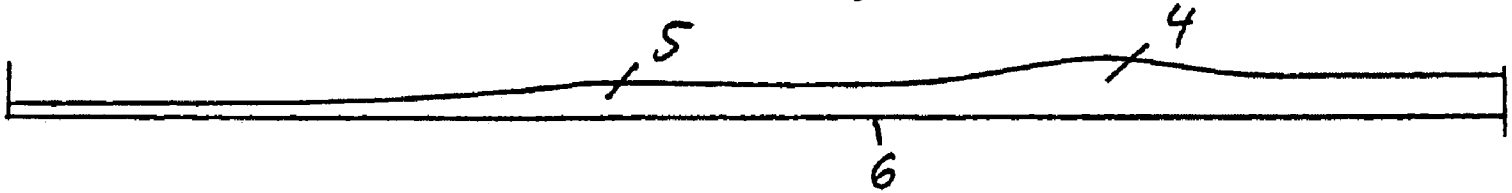
FIG. 2 schematically shows a side development of the outer side of the insole according to FIG. 1, FIG. 3 schematically shows a side development of the inner side of the insole according to FIG. 1.
Figure 1:
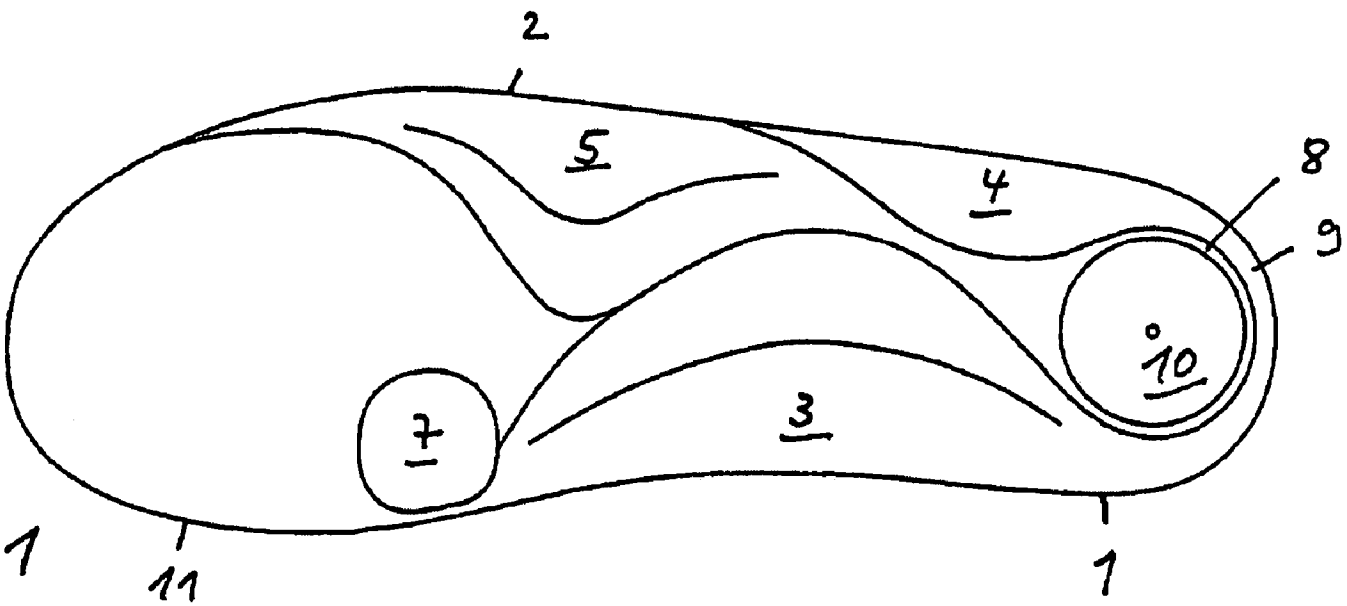
FIG. 1 schematically shows a plan view of the insole.

The insert has a topography which, as FIG. 1 shows in particular, is determined by a medial support 3 for the heel bone from inside in conjunction with a lateral first rise 4 and a lateral second rise 5.

The support of the longitudinal arch takes place by means of the support 3, which preferably supports only the Sustentalcum tali. This preferably becomes flatter towards the front, so that the periodic prolongations and shortenings of the longitudinal arch in the stance and swing phases of the gait are not hindered.

The medial support 3 extends from an insert inner border in the direction of the centre axis and has a maximum supporting height in the range from 10 to 17 mm for a moderate support of the medial longitudinal arch at the heel support (Sustentaculum tali) for initiating the midfoot locking during the twisting of the hindfoot towards the forefoot. A talipes valgus position is avoided, but the physiological damping function of the hindfoot is not hindered.

The medial support 3 is preferably formed by a pelotte, the height of which falls from the insert inner border towards the centre axis.

The first rise 4 is formed in the region of an insert outer border of the hindfoot part 1. The first rise 4 is preferably arranged in such a region of the hindfoot part 1 that it is located under the cleft of the Os cuboideum (cuboid bone), where the tendon of the long fibular muscle (M. peronaeus longus) enters the sole of the foot. The first rise 4 is to be positioned in such a way that it stimulates the tendon of the long fibular muscle where the tendon of the long fibular muscle laterally enters the sole of the foot.

The first rise 4 has for this purpose a raising peak at the outer border of the hindfoot part 1 which preferably has a height of from 8 to 16 mm with respect to the bottom surface 6 of the insert. The first rise 4 preferably extends in a locally limited manner from the outer border of the hindfoot part 1 of the insert in the direction of the centre axis. With respect to a raising peak, the first rise 4 flattens off from the outer border on all sides. The first rise 4 preferably has a width of from 10 to 35% of the overall width of the hindfoot part 1. The first rise 4 is preferably formed by a pelotte. The first rise 4 may have the shape of a convexity.

The second rise 5 is provided in the region of the insert outer border of the midfoot part 2. The first rise 4 is in this case formed higher than the second rise 5. The first rise 4 is preferably formed 50 to 80% higher than the second rise 5. The second rise 5 preferably has a surface-area raising peak at the outer border of the midfoot part 2, the height of which, measured from the bottom surface 6, preferably lies in the range from 2 to 9 mm. The flattening takes place from the outer border again on all sides. The second rise 5 preferably has in this case a width in the direction of the centre axis of the insert which is 1.5 to 2.5 times the width of the first rise 4. The second rise 5 is preferably formed by a pelotte. The second rise 5 may have the shape of a convexity.

The insert preferably has at the midfoot part 2 in the region of the insert inner border a slight medial depression 7. This depression 7 is preferably positioned where the ball of the big toe of a foot comes to bear, in order to achieve a slight lowering of the first metatarsal ray. This depression 7 is formed in the manner of a surface area. The second rise 5 and the slight depression 7 of the first metatarsal ray lead to a locking of the front part of the lower ankle joint, emphasize the longitudinal arch, improve the introduction of force between the hindfoot and midfoot and improve the stability in the pushing-off phase.

The depression 7 is preferably formed as a dip with a depth of preferably 0.5 to 2 mm. If the insert is not formed as part of the sole, but according to FIG. 1 as the entire sole, it also has a forefoot part 11. The depression 7 preferably extends on the midfoot side in the region of the insert inner border into the forefoot part 1.

The hindfoot part 1 may have further topographical features. These include a slightly convex formation of a heel impact area 8 in the region of the hindfoot part 1. The hindfoot part 1 may for this purpose have an edge 9 running around the border. A natural distribution of the heel pad for the evolvement of a physiological damping is supported as a result, the heel being fixed in the centre and the maximum impact pressure being displaced slightly forwards.

The heel part 1 may finally have a circular rise 10 in the region of the heel impact area. The rise 10 for the heel and the first rise 4 are preferably arranged offset at least partly in the longitudinal direction, the first rise 4 being arranged closer to the midfoot part 2 with respect to the rise 10 for the heel.

The insert or its topography may be incorporated directly in the bottom of the shoe (last) or be formed as an exchangeable insert sole for footwear. The material used for the insert preferably has a high dimensional stability, in order to ensure the effect throughout the wearing period. Preferred materials are polyethylene, polyurethane and nonwovens. The insert may in this case be produced in different degrees of hardness. The insert may also consist of different materials and/or be of a multi-ply configuration.

The medial support 3 for the medial longitudinal arch preferably extends on the hindfoot side in the direction of the midfoot part 2 from a region which extends from a heel portion, in order to hinder pushing forwards of the heel when it is set down on the heel impact area 8.

We claim:

1. Insole for footwear comprising an insert with at least one hindfoot part and a midfoot part and with a support for the medial longitudinal arch, wherein a first rise in the region of an insert outer border of the hindfoot part extends from an edge of the insert outer border of the hindfoot part towards a center axis of the insert, the first rise positioned to contact a part of the sole of a human foot where the tendon of the long fibular muscle enters the sole of the human foot, and a second rise is provided in the region of the insert outer border of a midfoot part, wherein the second rise is adapted to interface with the sole of a foot of a human and the first rise is formed higher than the second rise, and wherein the midfoot part has a surface-area depression on a forefoot side in the region of an insert inner border and wherein the hindfoot part has a circular rise on a heel portion.

2. Insole according to claim 1, wherein the first rise is arranged at least partly offset towards the midfoot part with respect to the circular rise of the heel portion.

3. Insole according to claim 1, wherein the first rise is formed 50 to 80% higher than the second rise.

4. Insole according to claim 3, wherein the first rise extends up to a width of 10 to 35% of a width of the hindfoot part on the latter.

5. Insole according to claim 4, wherein the second rise has a width in the direction of the centre axis which is 1.5 to 2.5 times a width of the first rise in the direction of the centre axis.

6. Insole according to claim 1, wherein the first rise has a raising peak at the outer border of the hindfoot part which has a height of from 8 to 16 mm and flattens off from there on all sides.

7. Insole according to claim 1, wherein the second rise has a surface-area raising peak at the outer border of the midfoot part with a height of from 2 to 9 mm and flattens off from there on all sides.

8. Insole according to claim 7, wherein a heel impact area in the region of the hindfoot part is formed in a slightly convex manner.

9. Insole according to claim 8, wherein the hindfoot part has an edge running around the border.

10. Insole according to claim 1, wherein the insert comprises a forefoot part, which on the midfoot side continues a surface-area depression of the midfoot part in the region of the insert inner border.

11. Insole according to claim 10, wherein the surface-area depression is provided in the region of the ball of a big toe.

12. Insole according to claim 11, wherein the depression is formed as a dip.

13. Insole according to claim 10, wherein the depression has a depth of from 0.5 to 2 mm.

14. Insole according to claim 13, wherein the support for the medial longitudinal arch extends on the hindfoot side in the direction of the midfoot from a region which extends from a heel portion.

15. Insole according to claim 14, wherein the first and second rises are respectively formed by a pelotte.

16. Insole according to claim 15, wherein the insert has a cover layer.

17. Insole according to claim 1, wherein it is formed in a lasting bottom of a shoe.

* * * * *